United States Patent [19]

Bannister

[11] 4,121,718

[45] Oct. 24, 1978

[54] DISPLAY RACKS

[75] Inventor: Alfred Bannister, St. Helens, England

[73] Assignee: Eric Slinn & Son Limited, St. Helens, England

[21] Appl. No.: 447,834

[22] Filed: Mar. 4, 1974

[30] Foreign Application Priority Data

Mar. 3, 1973 [GB] United Kingdom ..... 10430/73

[51] Int. Cl.[2] ..... A47F 7/00

[52] U.S. Cl. ..... 211/49 R; 211/134

[58] Field of Search ..... 211/49, 90, 134, 135, 211/149, 151, 153, 186, 187

[56] References Cited

U.S. PATENT DOCUMENTS

| | | | |
|---|---|---|---|
| 751,466 | 2/1904 | Colling | 211/134 X |
| 1,335,286 | 3/1920 | Leonard | 211/134 UX |
| 1,598,727 | 9/1926 | Jones | 211/90 |
| 1,716,964 | 6/1929 | Kuck | 211/135 X |
| 1,931,403 | 10/1933 | Connor | 211/49 D X |
| 2,322,748 | 6/1943 | Shaw et al. | 211/126 X |
| 2,623,641 | 12/1952 | Shield | 211/49 D |
| 3,207,098 | 9/1965 | Alpert | 211/49 R |
| 3,220,557 | 11/1965 | Brandes | 221/40 |
| 3,317,056 | 5/1967 | Alpert | 211/148 X |

FOREIGN PATENT DOCUMENTS

| | | | |
|---|---|---|---|
| 645,406 | 7/1962 | Canada | 211/49 R |
| 1,013,231 | 7/1952 | France | 211/186 |
| 1,058,054 | 11/1953 | France | 211/49 R |
| 196,911 | 12/1964 | Sweden | 211/49 R |
| 142,944 | 1/1931 | Switzerland | 211/187 |
| 372,806 | 12/1963 | Switzerland | 211/90 |
| 4,320 of | 1905 | United Kingdom | 312/193 |
| 1,068,579 | 5/1967 | United Kingdom | 211/90 |

*Primary Examiner*—Lawrence J. Staab

*Attorney, Agent, or Firm*—Shoemaker and Mattare, Ltd.

[57] ABSTRACT

Display rack having pairs of rails on which elongated articles such as rolls of wallpaper can be supported. The rails are inclined to the horizontal and have abutments at their lower ends.

5 Claims, 1 Drawing Figure

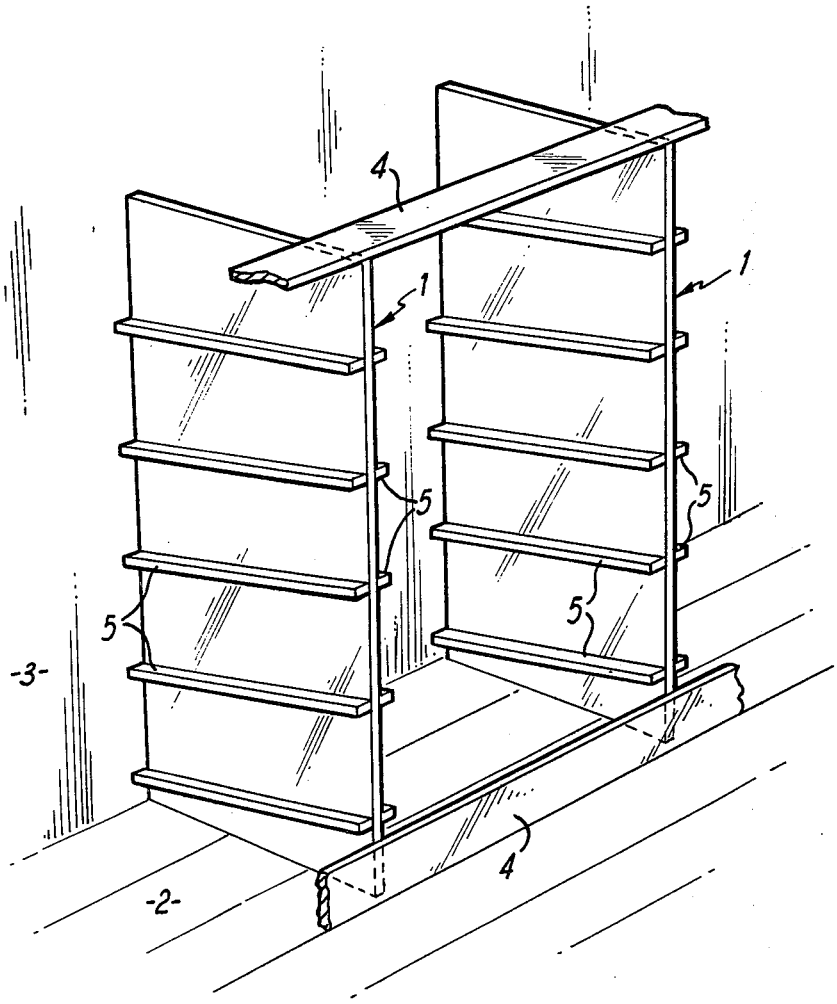
4
1
1
5
5
5
5
-3-
-2-
4

DISPLAY RACKS

This invention relates to display racks for displaying elongated articles particularly but not exclusively cylindrical articles such as rolls of wallpaper.

According to the invention there is provided a display rack, for displaying elongated articles particularly cylindrical articles such as rolls of wallpaper, comprising at least two spaced apart side-by-side upright support structures, a plurality of pairs of rails mounted in vertically spaced disposition on the support structures, the rails of each pair being mounted in confronting relationship respectively on adjacent such support structures and being inclined in a common direction to the horizontal, and an abutment surface at or closely adjacent the lower end of each rail.

With this arrangement it will be appreciated that elongated articles, as for example rolls of wallpaper, can be supported by each pair of rails by engagement of ends of such articles with the rails.

Preferably, the rails of each pair are parallel to each other. All the rails may be inclined in a common direction and may be parallel to each other. Alternatively other arrangements may be adopted, for example, the bottom rails may be inclined in one direction and all other rails in the opposite direction.

The support structures may be in the form of walls, provided for example by wooden boards, and the rails may be adjustably or permanently attached thereto by interengagement of co-operating configurations or by screws, nails or the like.

Alternatively, the support structures may be frameworks having front and back upright elongated members between which the rails are secured. At least one of the elongated members of each support structure may be formed with a cross-web and such cross-webs may be arranged to provide the said abutment surfaces. Both elongated members of each support structure may be formed with cross-webs so as to provide abutment surfaces at both ends of the rails. The rails may have cross-webs arranged to form end stops for the articles supported thereon.

One embodiment of the invention will now be described by way of example only with reference to the accompanying drawing which is a diagrammatic perspective view of one form of a display rack according to the invention.

The display rack is for use in a shop or like establishment for displaying rolls of wallpaper and comprises a number of equally spaced parallel upright walls 1, only two of which are shown for the sake of simplicity.

The walls 1, which are formed by wooden boards, stand on a floor surface 2 and have rear vertical edges thereof in abutment with a surface provided by a wall 3 of the shop.

The walls 1 are secured together top and bottom by planks 4 and are also secured at their rear edges to the wall 3.

On the mutually confronting surfaces of each pair of adjacent walls 1 there are mounted straight wooden rails 5, as for example by engagement of such rails with slots in the walls 1. The rails 5 on each said surface each extend from the front edge to the rear edge of the surface and are equally vertically spaced and parallel to each other. The rails 5 on one of the said confronting surfaces are parallel to and level with the rails 5 on the other surface.

The rails 5 are inclined to the horizontal such that the rear ends thereof against the wall 3 are lower than the front ends thereof.

In use, rolls of wallpaper are stacked on each pair of horizontally aligned rails 5. Such rolls will, due to the inclination of the rails, move backwards until restrained by abutment with the wall 3.

The above described arrangement is extremely simple and inexpensive to manufacture and install. Further, due to the inclination of the rails, a neat display can be maintained even after removal of rolls. Still further, the absence of solid shelves between the walls 1 facilitates maintenance and cleaning and at the same time improves visibility of displayed articles in that as a stack of rolls is depleted the next adjacent stacks thereabove and therebelow are further revealed. Still further, it will be readily appreciated that the arrangement enables many rolls to be stored and displayed without taking up large areas of floor space.

It will be appreciated that the invention is not intended to be restricted to the details of the embodiment hereinbefore described. Thus, for example, the wall 1 need not be secured to the wall 3 but instead the system may be free standing, struts or the like being provided to link the rear edges of the walls 1. In this case, the wall 3 may still provide the vertical abutment surface to limit rearward movement of rolls on the rails, the walls 1 thus being positioned sufficiently close to the wall, or, alternatively abutment surfaces may be provided by appropriate positioning of the struts or by special provision of members at the rear edges of the walls and projecting sideways therefrom. Where the wall 3 is not required to provide an abutment surface it will be appreciated that the display rack can be positioned in any suitable manner not necessarily against or adjacent a wall and thus for example may be positioned back-to-back with a further like display rack. Further, instead of wooden walls 1 frameworks of, for example, angle irons may be used, each such framework comprising for example front and rear upright angle irons suitably secured in spaced relationship with respect to each other and also with respect to the next adjacent framework or frameworks as for example by top and bottom angle irons. With this arrangement the rails may also be angle irons and these may be adjustably secured to the uprights by engagement of pins, hooks or the like thereon with holes in the uprights. The webs of the angle irons forming the rails will act as end stops for the rolls of wallpaper supported thereon. The rear angle irons may be arranged such that webs thereof provide the rear abutment surfaces. Similarly, the front angle irons may provide front abutment surfaces useful in preventing rolls from falling forward where rolls are stacked in rows on top of each other on each pair of rails.

In whatever form the display rack of the invention takes it will be appreciated that any suitable material such as wood, metal or plastics, or any suitable combination of materials, may be used.

What I claim is:

1. A display rack for displaying elongated articles, said rack having a front and a back and comprising in combination:

a plurality of rolls of wallpaper;

at least two spaced apart side-by-side upright support structures, each support structure having opposite planar surfaces and each having defined in each of said planar surfaces a plurality of spaced apart slots arranged in substantially coplanar relationship with corresponding slots on the other support structure and inclined in a common direction to the horizontal, with the direction of inclination of said slots being such that the upper ends of said slots are positioned at the front of the display rack;

a plurality of elongated rails, each rail having one longitudinal side edge which is engaged in a cooperating slot, said each rail being supported by the engagement of said one longitudinal edge in said cooperating slot, said rails being mounted in vertically spaced disposition in said slots with corresponding rails on adjacent support structures arranged in substantially coplanar relationship with one another to define opposed pairs of spaced apart rails, the rails of each pair inclined in a common direction to the horizontal and each having an upper end and a lower end and having upwardly facing freely exposed support surfaces for supporting opposite end portions of elongated articles thereon, the direction of inclination of the rails being such that the upper ends of the rails are positioned at the front of the rack, said spaced slots on said support structures being spaced apart a distance greater than the combined diameter of several rolls of said plurality of rolls of wallpaper so that a plurality of rolls of wallpaper can be stacked on top of each other on each pair of rails;

an end abutment surface adjacent the lower end of each rail to prevent the articles from rolling off of said rails; and a side abutment surface alongside each rail for retaining said elongated articles endwise on said support surfaces, thus resulting in a display rack for elongate, cylindrical articles, wherein an article may be removed from the tracks without disturbing or displacing adjacent articles on the tracks.

2. A display rack according to claim 1, wherein all the rails are inclined in a common direction.

3. A display rack according to claim 2, wherein the upright supports comprise a pair of substantially flat, upright, rectangularly shaped walls having confronting surfaces, and said rails comprise elongate strips secured edgewise to the confronting surfaces of the walls and extending substantially the width of the walls and said strips each projecting substantially perpendicularly from the plane of the respective walls.

4. A display rack according to claim 3, wherein additional strips are secured on the opposite surface of each wall in positions corresponding to the positions of the strips on the confronting surfaces of the walls.

5. The rack of claim 1, wherein said each rail is supported solely by the engagement of said one longitudinal edge in said cooperating slot.

* * * * *